United States Patent [19]

Yahalom

[11] 4,316,779

[45] Feb. 23, 1982

[54] PROCESS FOR ELECTROPLATING PALLADIUM ON ARTICLES COMPRISING COPPER

[75] Inventor: Joseph Yahalom, Summit, N.J.

[73] Assignee: Bell Telephone Laboratories, Incorporated, Murray Hill, N.J.

[21] Appl. No.: 191,166

[22] Filed: Sep. 26, 1980

[51] Int. Cl.[3] ..... C25D 3/52; C25D 5/34

[52] U.S. Cl. ..... 204/29; 204/47

[58] Field of Search ..... 204/47, 43 N, 109, 29

[56] References Cited

U.S. PATENT DOCUMENTS

| | | | |
|---|---|---|---|
| 1,921,941 | 8/1933 | Powell et al. | 204/47 |
| 1,970,950 | 8/1934 | Wise | 204/47 |
| 1,981,715 | 11/1934 | Atkinson | 204/47 |
| 1,993,623 | 3/1935 | Raper | 204/47 |
| 2,452,308 | 10/1948 | Lambros | 204/47 |
| 3,150,065 | 9/1964 | Fatzer | 204/47 |
| 3,458,409 | 7/1969 | Hayashi et al. | 204/43 N |
| 3,544,435 | 12/1970 | Angus et al. | 204/47 |
| 3,920,526 | 11/1975 | Caricchio et al. | 204/47 |
| 4,098,656 | 7/1978 | Deuber | 204/47 |

FOREIGN PATENT DOCUMENTS

| | | | |
|---|---|---|---|
| 1017950 | 1/1966 | United Kingdom | 204/47 |

OTHER PUBLICATIONS

Metal Finishing Guidebook and Directory, p. 360, (1974).

*Primary Examiner*—G. L. Kaplan

*Attorney, Agent, or Firm*—Walter G. Nilsen

[57] ABSTRACT

A process and bath composition is described for the electroplating of palladium. The bath contains a source of palladium and thiourea or related compounds to prevent poisoning of the bath from copper ions contained on surfaces to be plated. It is particularly useful in palladium electroplating processes where foreign ions such as copper ions adversely affect the plating process. Such contamination is likely to occur where palladium is electroplated on copper or copper alloy surfaces such as are used in electrical contact devices such as switches, relays, connectors, etc. The palladium electroplating process and bath described in the disclosure yields excellent results even where extensive impurities such as copper ions have been introduced into the plating bath.

14 Claims, 1 Drawing Figure

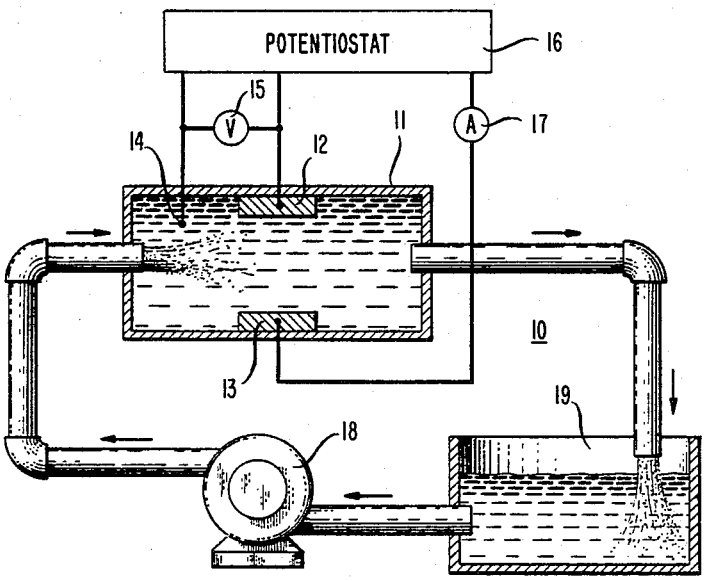
POTENTIOSTAT
16
15
V
A
17
14
12
11
10
13
19
18

PROCESS FOR ELECTROPLATING PALLADIUM ON ARTICLES COMPRISING COPPER

TECHNICAL FIELD

The invention is a bath composition and process for electroplating palladium. This process and bath composition is particularly useful for electroplating palladium on copper or copper alloy surfaces such as is used in many electrical devices.

BACKGROUND OF THE INVENTION

Palladium and palladium alloys are known to be useful in a variety of industrial applications including the fabrication of jewelry, optical devices, electronic circuits and devices. Palladium and its alloys are attractive because of chemical inertness, surface luster, high electrical conductivity and excellent surface properties, particularly for electrical contacts. In many applications chemical inertness is highly advantageous for long life and high reliability. In addition, its high electrical conductivity makes palladium particularly useful in various electrical devices including electrical contacts such as are used in relays, switches and electrical contacts. Various palladium alloys such as palladium-silver are also useful for like applications. Indeed, because of the increasing cost of gold, palladium often appears more attractive economically as a contact material than is gold. For this reason, it is economically attractive to have an electroplating process for reliably plating ductile and adherent palladium to surfaces.

In particular, it is highly desirable to have an electroplating process which is highly reliable despite the possible introduction of foreign ions into the electroplating bath. It is also highly desirable to have a bath composition which permits reliable, efficient palladium plating even where foreign ions might be introduced into the plating bath. This is most critical in plating various types of electrical connectors and other electrical devices because of the possible introduction of copper ions into the plating bath.

Palladium electroplating processes and baths have been described in a number of references including: U.S. Pat. No. 1,970,950 issued to E. M. Wise on Aug. 21, 1934; U.S. Pat. No. 1,993,623 issued to A. R. Raper on Mar. 5, 1935; U.S. Pat. No. 1,981,715 issued to R. H. Atkinson on Nov. 20, 1934; U.S. Pat. No. 3,920,526 issued to J. J. Caricchio, Jr. et al on Nov. 18, 1975; U.S. Pat. No. 1,921,941 issued to A. R. Powell et al on Aug. 8, 1933; U.S. Pat. No. 3,544,435 issued to H. C. Angus et al on Dec. 1, 1970; U.S. Pat. No. 3,458,409 issued to S. Hayashi et al on July 29, 1969; U.S. Pat. No. 2,452,308 issued to G. C. Lambros on Oct. 26, 1948; and U.S. Pat. No. 3,150,065 issued to G. D. Fatzer on Sept. 22, 1964.

SUMMARY OF THE INVENTION

The invention is a process and bath composition for electroplating palladium. The process is carried out in an aqueous ammonia bath containing a palladium amine complex and thiourea or a derivative of thiourea. A wide variety of thiourea derivatives may be used; preferred are those in which one or more of the hydrogen atoms attached to the nitrogen atom are substituted with a hydrocarbon group with up to 10 (preferably up to 6) carbon atoms. Alkane and benzene substituents are most preferred and unsubstituted thiourea most preferred because of solubility and low cost. Such palladium plating processes and bath compositions yield excellent results even where palladium is plated on copper or copper alloys or where copper is inadvertently introduced into the plating solutions. The process and bath yield excellent results where used to make electrical contact surfaces such as is used in switches, relays, connectors and the like. The plating apparatus, currents, potentials, counter-electrode, etc., may be conventional.

BRIEF DESCRIPTION OF THE DRAWING

The FIGURE shows a typical plating apparatus useful for plating palladium.

DETAILED DESCRIPTION

For convenience, the structural formula for thiourea is set forth below. Thiourea itself is where $R_1$, $R_2$, $R_3$ and $R_4$ are hydrogen substituents.

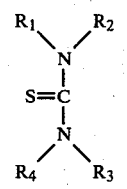

The invention in its broadest terms is the use of thiourea and certain derivatives of thiourea (collectively referred to as thiourea compound) to prevent interference in palladium electroplating processes by introduction of foreign ions such as copper ions into the plating bath. Thiourea is useful as are many derivatives, particularly those with relatively inert (alkane, alkene, aromatic, etc.) substituents attached to the nitrogen atoms. More than one compound may be used. Concentration of the thiourea compound may vary over large limits (for example, $10^{-4}$ molar to saturation). Preferred is a range which ensures effective repression of foreign-ion poisoning (about $10^{-4}$ molar) to where material (usually palladium complex ion or conducting salt) is precipitated out of the electroplating bath (0.1, 0.01 or 0.001 molar, depending on palladium complex concentration and conducting salt concentration). Higher concentrations than 0.1 molar still yield excellent results but are usually wasteful of material and limits the concentration of other materials (i.e., palladium complex) which contribute to efficient operation of the electroplating process.

Although it would seem most convenient to include the thiourea compound in the plating bath, the surface to be plated may be exposed to thiourea compound prior to palladium plating. Further, the ingredients of the bath may be supplied separately in solid form or in the form of a concentrated solution and diluted to the desired concentration. Also, the bath may be replenished (i.e., with palladium or thiourea compound) with solid or concentrated solution.

In broad terms, the electroplating bath should contain a source of palladium as an amine complex and some free ammonia to adjust the pH of the solution and to stabilize the palladium amine complex. The bath should also contain thiourea or a derivative of thiourea. Typical thiourea derivatives are N-allyl N',N' diethylthiourea, N-allylthiourea, N,N' diallylthiourea, N,N' dibenzylthiourea, N,N' dibutylthiourea, N,N' diethylthiourea, N,N diethylthiourea, N,N diphenylthiourea, N phenylthiourea and N,N' dimethylthiourea. As stated above, thiourea is preferred. It is preferred that the thiourea compound be added to the plating bath but some benefit may be obtained by soaking the surface to be plated in a solution of thiourea compound prior to introduction into the plating bath.

The concentration of palladium may vary over large limits provided plating takes place. Concentration ranges (in terms of palladium metal) between 1 mg/l and saturation are useful but more usually the concentration range is between 10 g/l and saturation. For certain applications, especially where rapid plating is desirable, a concentration range between 50 g/l or even 100 g/l and saturation is preferred. Economic considerations often limit the concentration rather than plating considerations. Also, increasing the concentration of thiourea compound often reduces the solubility of palladium complex so that where high concentrations of thiourea compound is desirable, the palladium complex concentration might be reduced. Conducting salts are often added such as ammonium chloride, ammonium phosphate, ammonium sulfamate, ammonium formate, ammonium sulfate, ammonium carbonate, etc. Aqueous ammonia is added to adjust pH and stabilize the palladium complex.

The pH may vary over large limits but is typically between 7 and 12, with 8–10 preferred. This leads to maximum stability of the plating solution and ensures minimum attack on the surface to be plated. Particular plating solutions (for example, those given below) have preferred pH ranges which maximize plating rates and yield excellent palladium film properties. Stirring or agitation of the bath is usually beneficial, particularly for higher plating rates. The pH is preferably adjusted by the addition of aqueous ammonia solution.

Some typical ammoniacal palladium baths are as follows:

EXAMPLE 1

$Pd(NH_3)_2(NO_2)_2$
Thiourea compound
$NH_4NO_3$ (optional)
$NaNO_2$ (optional)
Aqueous Ammonia to pH 8–10

EXAMPLE 2

$Pd(NH_3)_4(NO_3)_2$
Thiourea compound
Conducting salts (optional)
Aqueous Ammonia to pH 7–10

EXAMPLE 3

$Pd(NH_3)_2Cl_2$
Thiourea compound
Ammonium salts (optional)
Aqueous Ammonia to pH 8–12, 8.8 to 9.2 preferred.

EXAMPLE 4

$Pd(NH_3)_4Br_2$
Thiourea compound
Aqueous Ammonia to pH 9–10, 9.5 to 10 preferred.

Other palladium complexes such as the corresponding sulfate, phosphate, tartrate, citrate, oxalate and carbonate also may be useful.

The preferred plating bath contains $Pd(NH_3)_4Cl_2$ as the source of palladium. Amounts of at least 10 g/l (in terms of palladium metal) are preferred with (optionally) various salts such as $NH_4Cl$ added as conducting salts. Sufficient aqueous ammonia is added to yield a pH between 8 and 10, preferably 9.0. Higher concentrations of $Pd(NH_3)_4Cl_2$ are more preferred, say greater than 20 g/l or even 100 g/l. Increased concentration of the palladium complex reduces the amount of conducting salts (i.e., $NH_4Cl$) that can be dissolved in the bath. Indeed, often high concentrations of palladium species yield superior plating results, particularly where high plating rates are used. Where very high concentrations of palladium salt is used, the addition of conducting salt such as $NH_4Cl$ is often omitted.

An excellent bath for the practice of the invention is 80 g/l (in terms of Pd metal) of $Pd(NH_3)_4Cl_2$, 0.001 molar thiourea and sufficient aqueous ammonia to $pH=9\pm0.2$.

The plating apparatus and plating procedure is not critical and conventional methods well known in the art may be used. A particularly useful type of plating apparatus is a strip line electroplating apparatus (see, for example, U.S. Pat. No. 4,153,523 issued to Koontz et al on May 8, 1979). With such an apparatus, the surface to be plated may be exposed to thiourea compound prior to the plating bath (even in one of the rinse baths) or in the plating bath.

The FIGURE is a schematic view of a typical plating apparatus 10, showing plating cell 11 with working electrode 12 and counter electrode 13. Also shown is a reference electrode 14 together with a voltmeter 15 for monitoring the plating potential and a potentiostat 16. The potentiostat supplies sufficient current as measured by the ammeter 17 to maximize plating current without exceeding a predetermined plating potential. Plating solution is pumped into the plating cell 11 by means of a liquid pump 18. A reservoir 19 receives bath solution coming out of the plating cell. Typically, the potentiostat supplies sufficient voltage so that current passes from the working electrode through the plating solution and into the counter electrode. Current is controlled by the potentiostat so as to fix the working electrode potential at a preset value. Naturally, where close control of the working electrode potential is not necessary, the potentiostat can be replaced by a source of electrical energy of sufficiently high voltage and current to carry out the plating procedure. It should be emphasized that plating may also be carried out in a conventional manner without control of current or potential.

What is claimed is:

1. A process for electroplating palladium onto a surface comprising copper from an aqueous ammonia plating bath comprising a source of palladium for electroplating, said source of palladium comprising $Pd(NH_3)_4Cl_2$, said process comprising the step of passing current through cathode, plating bath and anode characterized in that the surface is exposed to a solution comprising at least one thiourea compound selected from the group consisting of thiourea and substituted thiourea with at least one substituent on at least one of the nitrogen atoms, said substituent selected from the group consisting of hydrocarbons with up to 10 carbon atoms.

2. The process of claim 1 in which the substituent is an alkyl group, an alkenyl group or a phenyl group.

3. The process of claim 1 in which the thiourea compound is selected from the group consisting of thiourea, N-allyl N',N'diethylthiourea, N-allylthiourea, N,N'diallylthiourea, N,N'dibenzylthiourea, N,N'dibutylthiourea, N,N'diethylthiourea, N,N-diethylthiourea, N,N diphenylthiourea, N phenylthiourea and N,N'dimethylthiourea.

4. The process of claim 1 in which the thiourea compound is thiourea with concentration between 0.0001 molar and saturation.

5. The process of claim 1 in which the concentration of the thiourea compound is between 0.0001 and 0.01 molar.

6. The process of claim 5 in which the concentration of thiourea compound is between 0.0001 and 0.001 molar.

7. The process of claim 1 in which the palladium amine complexing ion has a concentration (in terms of palladium metal) between 1 mg/l and saturation.

8. The process of claim 7 in which the palladium concentration is between 10 g/l and saturation.

9. The process of claim 8 in which the palladium concentration is between 50 g/l and saturation.

10. The process of claim 1 in which the pH is between 7 and 12.

11. The process of claim 10 in which the pH is between 8 and 10.

12. The process of claim 1 in which the thiourea compound is included in the plating bath.

13. The process of claim 1 in which the bath further comprises conducting salts selected from the group consisting of ammonium chloride, ammonium phosphate, ammonium sulfamate, ammonium formate, ammonium sulfate, ammonium carbonate.

14. The process of claim 1 in which the plating bath consists essentially of 80 g/l palladium metal added as $Pd(NH_3)_4Cl_2$, 0.001 molar thiourea and sufficient aqueous ammonia to give a $pH=9\pm0.2$.

* * * * *